US007744187B2

(12) United States Patent
Iwakura

(10) Patent No.: US 7,744,187 B2
(45) Date of Patent: Jun. 29, 2010

(54) RECORDING APPARATUS

(75) Inventor: Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 322 days.

(21) Appl. No.: 11/836,014

(22) Filed: Aug. 8, 2007

(65) Prior Publication Data

US 2008/0049061 A1 Feb. 28, 2008

(30) Foreign Application Priority Data

Aug. 22, 2006 (JP) ..... 2006-225510

(51) Int. Cl.
*B41J 29/38* (2006.01)
*B41J 29/393* (2006.01)
*B41J 2/01* (2006.01)

(52) U.S. Cl. ..... 347/16; 347/19; 347/104

(58) Field of Classification Search ..... 347/16, 347/19, 104
See application file for complete search history.

(56) References Cited

FOREIGN PATENT DOCUMENTS

JP 2004-175092 A 6/2004
JP 2005007817 A * 1/2005

* cited by examiner

*Primary Examiner*—Matthew Luu
*Assistant Examiner*—Jannelle M Lebron
(74) *Attorney, Agent, or Firm*—Canon USA Inc IP Division

(57) ABSTRACT

A recording apparatus calculates a third correction value for a conveying amount of a recording material when the trailing end of the recording material is separated from a conveying roller using a first correction value for a conveying amount in an area of the recording material conveyed by the conveying roller and an eject roller and a second correction value for a conveying amount in an area of the recording material conveyed by only the eject roller.

17 Claims, 7 Drawing Sheets

RECORDING APPARATUS

BACKGROUND OF THE INVENTION

1. Field of the Invention

The present invention relates to recording apparatuses for making a recording on recording materials using recording heads, and more specifically, relates to a recording apparatus including a conveying roller disposed upstream of a recording head and an eject roller disposed downstream of the recording head, and capable of recording on recording materials using the recording head even after the trailing ends of the recording materials pass through the conveying roller.

2. Description of the Related Art

Among conventional recording apparatuses, some include a recording head for making a recording on recording materials while scanning in a main scanning direction, a conveying roller disposed upstream of the recording head for conveying the recording materials, and an eject roller disposed downstream of the recording head for conveying the recording materials. The conveying roller and the eject roller are driven by the torque of a DC motor transmitted via gears or timing belts. Moreover, a code wheel having marks with a pitch of about 150 to 300 lpi used for detecting the amount of rotation of the conveying roller is disposed on the shaft of the conveying roller or on a driving line adjacent to the conveying roller, and the amount of rotation of the conveying roller is controlled on the basis of signals output from an encoder sensor that reads the marks on the code wheel.

In such recording apparatuses, actual conveying amounts sometimes differ from a target value due to factors such as variations in outer diameters, deviations, and frictional coefficients of the conveying roller and the eject roller, conveyance load exerted on the recording material, stiffness of the recording material, and moisture in the recording material. When the actual conveying amount is larger than the target value, white streaks may be generated in images. In contrast, when the actual conveying amount is smaller than the target value, black streaks may be generated in images. There is a need to solve this problem with the recent development toward photorealistic printing.

In an attempt to solve this problem, the dimensions of parts of the conveying roller and the eject roller have been held to closer tolerances, or the conveying path of the recording materials has been changed so as to reduce the conveyance load exerted on the recording materials. However, these countermeasures cannot solve the problem completely.

In order to correct variations in the conveying amount in each apparatus, Japanese Patent Laid-Open No. 2004-175092 describes a technique for correcting the conveying amount of printing media on the basis of correction patterns printed on a printing sheet. Moreover, Japanese Patent Laid-Open No. 2004-175092 describes another technique for coping with errors in the conveying amount that differs in accordance with printing modes by correcting the conveying amount for each conveying speed or each print resolution, either of which differs in accordance with print quality. Furthermore, Japanese Patent Laid-Open No. 2004-175092 describes yet another technique for correcting the conveying amount in an area of a printing sheet conveyed by the conveying roller and the eject roller and the conveying amount in an area of the printing sheet conveyed by the eject roller after the trailing end of the printing sheet is separated from the conveying roller.

The techniques described in Japanese Patent Laid-Open No. 2004-175092 may correct the conveying amounts while the printing sheet is nipped by a conveying roller unit and an eject roller unit and while the printing sheet is nipped by only the eject roller unit. However, the techniques described in Japanese Patent Laid-Open No. 2004-175092 are not designed to correct the conveying amount when the trailing end of the printing sheet is separated from the conveying roller unit. The conveying amount of the printing sheet when the trailing end is separated from the conveying roller unit can be corrected on the basis of a correction pattern printed when the trailing end is separated from the conveying roller unit. However, it is necessary to print on a plurality of printing sheets while the correction value is changed since the trailing end of one printing sheet is separated from the conveying roller unit only one time. Thus, it is difficult to conduct such correction in practice.

SUMMARY OF THE INVENTION

An embodiment of the present invention is directed to a recording apparatus capable of calculating a correction value when the trailing end of a recording material is separated from a conveying roller unit and capable of high-quality recording using the correction value.

According to an aspect of the present invention, a recording apparatus includes a conveying roller configured to convey a recording material disposed upstream of a recording head for making a recording on the recording material in a direction in which the recording material is conveyed and an eject roller configured to convey the recording material disposed downstream of the recording head in the direction in which the recording material is conveyed. The recording apparatus is capable of recording in an area of the recording material while the recording material is engaged by the eject roller and not engaged the conveying roller using the recording head. The recording apparatus calculates a third correction value for a conveying amount of the recording material when the trailing end of the recording material is separated from the conveying roller using a first correction value for a conveying amount associated with an area of the recording material conveyed by the conveying roller and the eject roller and a second correction value for a conveying amount associated with an area of the recording material conveyed by only the eject roller.

Further features of the present invention will become apparent from the following description of exemplary embodiments with reference to the attached drawings.

DESCRIPTION OF THE EMBODIMENTS

Next, a recording apparatus according to an exemplary embodiment of the present invention will now be described.

Figure 1:
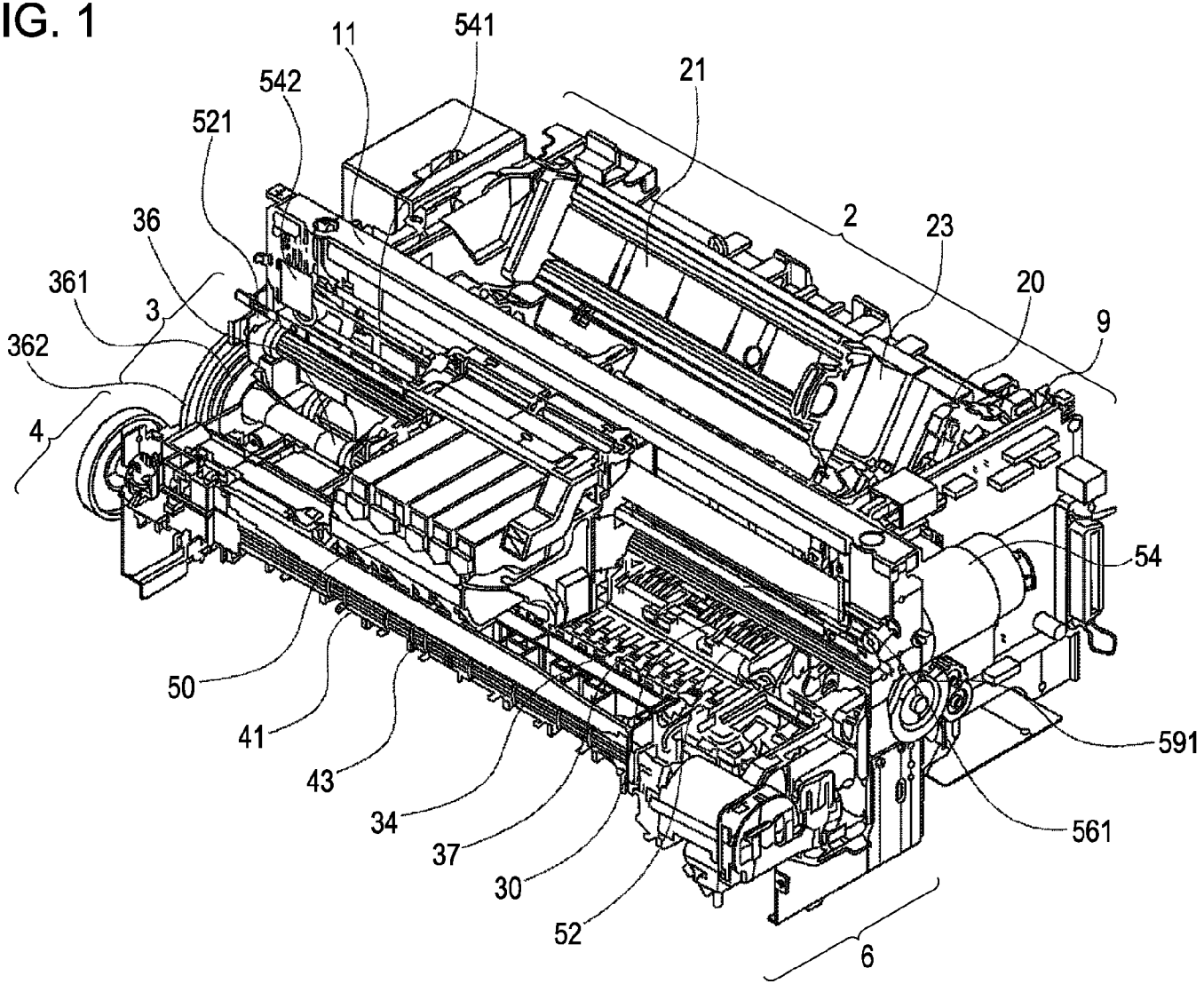
FIG. 1 is a perspective view of a recording apparatus according to an exemplary embodiment of the present invention.
Figure 2:
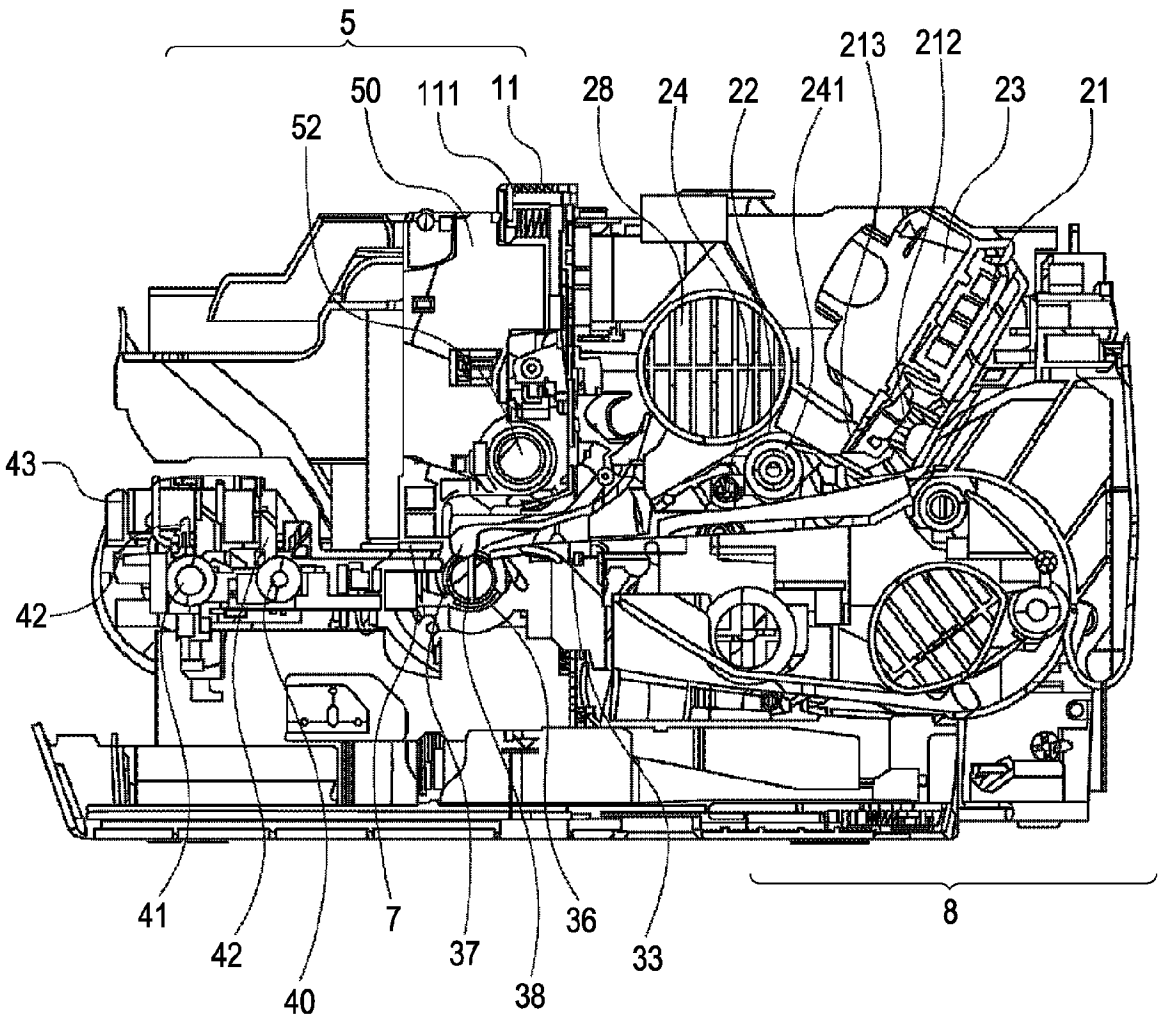
FIG. 2 is a cross-sectional view of the recording apparatus according to an exemplary embodiment of the present invention.

First, components for feeding recording materials, recording on the recording materials, and ejecting the recording materials in the recording apparatus will be described with reference to FIGS. 1 and 2. FIGS. 1 and 2 are a perspective view and a cross-sectional view, respectively, of the recording apparatus. The recording apparatus according to an exemplary embodiment of the present invention includes a feeding section 2, a conveying section 3, an ejecting section 4, a carriage section 5, a U-turn feeding/automatic conveying section for two-sided printing 8, a cleaning section 6, a recording head 7, and the like.

Feeding Section

The feeding section 2 includes a base 20 having a pressure plate 21 at which recording materials P are stacked, a feeding roller 28 that feeds the recording materials P, a separation roller 241 that separates the recording materials P into individual recording materials, a return lever 22 for returning the recording materials P to the original stacking position, and the like attached to the base 20. Moreover, a feeding tray for retaining the recording materials P stacked on the pressure plate 21 is attached to the base 20 or the exterior of the recording apparatus 1. The feeding roller 28 is a rod-shaped body having a circular cross section, and has a roller rubber for feeding the recording materials disposed at a position adjacent to a reference for stacking the recording materials. The feeding roller 28 is driven by the drive of a feeding motor transmitted via gear lines. The feeding motor is disposed in the feeding section 2, and also drives the cleaning section.

A movable side guide 23 is disposed on the pressure plate 21 so as to regulate the stacking position of the recording materials P. The pressure plate 21 is pivotable on a rotating shaft connected to the base 20, and is biased to the feeding roller 28 by a pressure plate spring 212. A separation sheet 213 is disposed at a position on the pressure plate 21 facing the feeding roller 28. The separation sheet 213 is composed of a material having a high frictional coefficient so as to prevent double feeding of the recording materials P that are stacked adjacent to the top sheet of the stacked recording materials P. The pressure plate 21 can be brought into contact with or be separated from the feeding roller 28 using a pressure plate cam.

Furthermore, the separation roller 241 for separating the recording materials P into individual recording materials is attached to a separation roller holder 24, and the separation roller holder 24 is rotatable about a rotating shaft provided for the base 20. The separation roller 241 is biased to the feeding roller 28 by biasing the separation roller holder 24 using a separation roller spring. The separation roller 241 has a clutch spring attached thereto, and can be rotated with respect to the separation roller holder 24 when a load larger than or equal to a predetermined value is applied to the separation roller 241. The separation roller 241 can be brought into contact with or be separated from the feeding roller 28 using a separation-roller release shaft and a control cam.

Moreover, the return lever 22 for returning the recording materials P to the original stacking position is attached to the base 20 so as to be rotatable, and is biased in a releasing direction by a spring. The recording materials P are returned to the original stacking position by rotating the return lever 22 against the biasing force of the spring using a control cam.

During normal standby, the pressure plate 21 is released from the feeding roller 28 using the pressure plate cam, and the separation roller 241 is released from the feeding roller 28 using the control cam. Moreover, the return lever 22 is disposed at a position for returning the recording materials P to the original stacking position and for closing a feeding port of the recording materials P such that the recording materials P do not enter the interior of the conveying section 3 during stacking of the recording materials P.

When a feeding process is started, the separation roller 241 is brought into contact with the feeding roller 28 by the drive of the feeding motor. Subsequently, the return lever 22 is released, and the feeding roller 28 is brought into contact with the recording materials P stacked on the pressure plate 21. Among the recording material P fed by the feeding roller 28, only a predetermined number of recording materials P limited by a preliminary separating part provided for the base 20 are sent to a nip formed between the feeding roller 28 and the separation roller 241. The recording materials P that have been fed are separated into individual recording materials at the nip formed between the feeding roller 28 and the separation roller 241, and only the top recording material P is fed to the conveying section 3.

When the recording material P reaches a conveying roller 36 and pinch rollers 37 (described below), the pressure plate 21 and the separation roller 241 are released using the pressure plate cam and the control cam, respectively. Moreover, the return lever 22 is returned to the initial position using the control cam. In accordance with this motion of the return lever 22, the recording materials P that have reached the nip formed between the feeding roller 28 and the separation roller 241 are returned to the original stacking position.

Conveying Section

The conveying section 3 is attached to a chassis 11 formed of a bent metal sheet. The conveying section 3 includes the conveying roller 36 that conveys the recording materials P and a paper end (PE) sensor. The conveying roller 36 is formed of a metallic shaft whose surface is coated with ceramic microparticles, and is attached to the chassis 11 by being received by bearings 38 at metallic portions at both ends of the shaft. Tension springs are disposed between the conveying roller 36 and the bearings 38 so as to bias the conveying roller 36, i.e., so as to apply a predetermined load to the conveying roller 36. The conveyance of the recording materials can be stabilized by this load.

A plurality of pinch rollers 37 that are driven by the conveying roller 36 are in contact with the conveying roller 36. Each of the pinch rollers 37 is held by a pinch roller holder 30, and is pressed into contact with the conveying roller 36 by a pinch roller spring so as to generate conveying force of the recording materials P. The rotating shaft of the pinch roller holders 30 is journaled in bearings attached to the chassis 11, and the pinch roller holders 30 are rotated about this rotating shaft. Furthermore, a paper guiding flapper 33 and a platen 34 that guide the recording materials P are disposed at the entrance of the conveying section 3 toward which the recording materials P are conveyed. Moreover, a PE sensor lever 31 that transmits the detection of the leading ends and the trailing ends of the recording materials P to the PE sensor is provided for the pinch roller holders 30. The platen 34 is positioned and attached to the chassis 11. The paper guiding flapper 33 is engaged with the conveying roller 36. The paper guiding flapper 33 is rotatable about a slidable bearing portion, and is positioned when the paper guiding flapper 33 is brought into contact with the chassis 11.

In the above-described configuration, the recording materials P fed to the conveying section 3 are guided by the pinch roller holders 30 and the paper guiding flapper 33, and sent to a conveying roller unit formed of the conveying roller 36 and the pinch rollers 37. At this moment, the leading ends of the conveyed recording materials P are detected by the PE sensor lever 31 and recording positions on the recording materials P are determined. Moreover, the recording materials P are conveyed along the platen 34 by the conveying roller unit rotated by a convey motor. The platen 34 has ribs formed on the surface thereof (serving as a reference surface for conveying the recording material P). These ribs control the distance between the recording materials P and the recording head 7, and at the same time, regulate undulation of the recording materials P in cooperation with the ejecting section 4 (described below).

The conveying roller 36 is driven by the driving force of the convey motor, which is a DC motor, transmitted to a pulley 361 disposed on the shaft of the conveying roller 36 using a timing belt. Moreover, a code wheel 362 for detecting the amount of rotation of the conveying roller 36 is disposed on the shaft of the conveying roller 36. Marks with a pitch of 150 to 300 lpi are formed on this code wheel 362. An encoder sensor for reading out the marks on the code wheel 362 is attached to the chassis 11 adjacent to the code wheel 362.

Moreover, the recording head 7 that makes a recording on the basis of image information is disposed downstream of the conveying roller 36 in a direction in which the recording materials are conveyed (conveying direction). The recording head 7 according to an exemplary embodiment is of the ink-jet type, and separate color ink tanks are attached to the recording head 7 so as to be exchangeable. This recording head 7 can apply heat to ink using heaters or the like, and the heat causes film boiling of ink. With this, the recording head 7 ejects ink from the nozzles thereof in accordance with pressure changes caused by growth or contraction of bubbles by the action of the film boiling, and forms images on the recording materials P.

Carriage Section

The carriage section 5 includes a carriage 50 in which the recording head 7 can be installed. The carriage 50 reciprocates for scanning in accordance with the guide by a guide shaft 52 disposed in a direction intersecting with the conveying direction of the recording materials P and a guide rail 111 supporting the rear end of the carriage 50 and maintaining a gap between the recording head 7 and the recording materials P. The guide shaft 52 is attached to the chassis 11, and the guide rail 111 is integrated with the chassis 11.

Moreover, the carriage 50 is driven by a carriage motor 54 attached to the chassis 11 via a timing belt 541. The timing belt 541 is extended and supported by an idler pulley 542. The timing belt 541 is connected to the carriage 50 via a damper composed of rubber or the like. This structure attenuates the vibration of the carriage motor 54 or the like, and reduces unevenness in images. A code strip 561 used for detecting the position of the carriage 50 is disposed parallel to the timing belt 541. Marks with a pitch of 150 to 300 lpi are formed on the code strip 561. Furthermore, an encoder sensor for reading the marks on the code strip 561 is disposed on the carriage 50.

Moreover, eccentric cams 521 are disposed at either end of the guide shaft 52 so as to move the guide shaft 52 up and down when a driving force is transmitted to the eccentric cams 521 via a gear line 591. With this, the distance between the carriage 50 and the recording materials P can be maintained at an optimum value even when the thicknesses of the recording materials P differ.

When images are formed on the recording materials P in the above-described structure, the recording materials P are conveyed to a line position for image forming (position in the conveying direction of the recording materials P) by the conveying roller unit, and at the same time, the carriage 50 is conveyed to a column position for image forming (position in the direction intersecting with the conveying direction of the recording materials P) by the carriage motor 54. With this arrangement, the recording head 7 faces a position for image forming. Subsequently, the recording head 7 ejects ink toward the recording materials P in accordance with signals output from an electrical board 9 so as to form images.

Ejecting Section

The ejecting section 4 includes a first eject roller 40, a second eject roller 41, driven rollers 42 biased to the eject rollers 40 and 41 so as to rotate in response to the rotation of the eject rollers, gear lines for transmitting the drive of the conveying roller 36 to the eject rollers 40 and 41, and the like.

The first eject roller 40 and the second eject roller 41 are attached to the platen 34. The second eject roller 41 disposed downstream of the first eject roller 40 in the conveying direction of the recording material P includes a metallic shaft and a plurality of rubber portions attached to the metallic shaft. The first eject roller 40 disposed upstream of the second eject roller 41 in the conveying direction of the recording material P includes a resin shaft and a plurality of elastic bodies composed of an elastomer attached to the resin shaft. The drive of the conveying roller 36 is first transmitted to the second eject roller 41 via idler gears. Subsequently, the drive of the second eject roller 41 is transmitted to the first eject roller 40 via idler gears.

The driven rollers 42 can be formed of SUS sheets having protruding portions on the peripheries thereof and resin portions integrated with the sheets. The driven rollers 42 are attached to a driven roller holder 43, and pressed into contact with the eject rollers 40 and 41 using driven roller springs formed of rod-shaped coil springs. The driven rollers 42 can be classified into those, disposed at positions corresponding to those of the elastic bodies of the first eject roller 40 and the rubber portions of the second eject roller 41, for mainly generating the conveying force of the recording materials P and those, disposed at positions where no elastic bodies and no rubber portions lie, for mainly preventing the recording materials P from floating during recording.

With the above-described structure, the recording materials P on which images are formed in the carriage section 5 are conveyed while being nipped between the eject rollers 40 and 41 and the driven rollers 42, and are ejected to a paper output tray.

Next, a structure for correcting the conveying amount of the recording materials P, which is a feature of the present invention, will be described with reference to FIGS. 3A to 7.

Figure 3A:
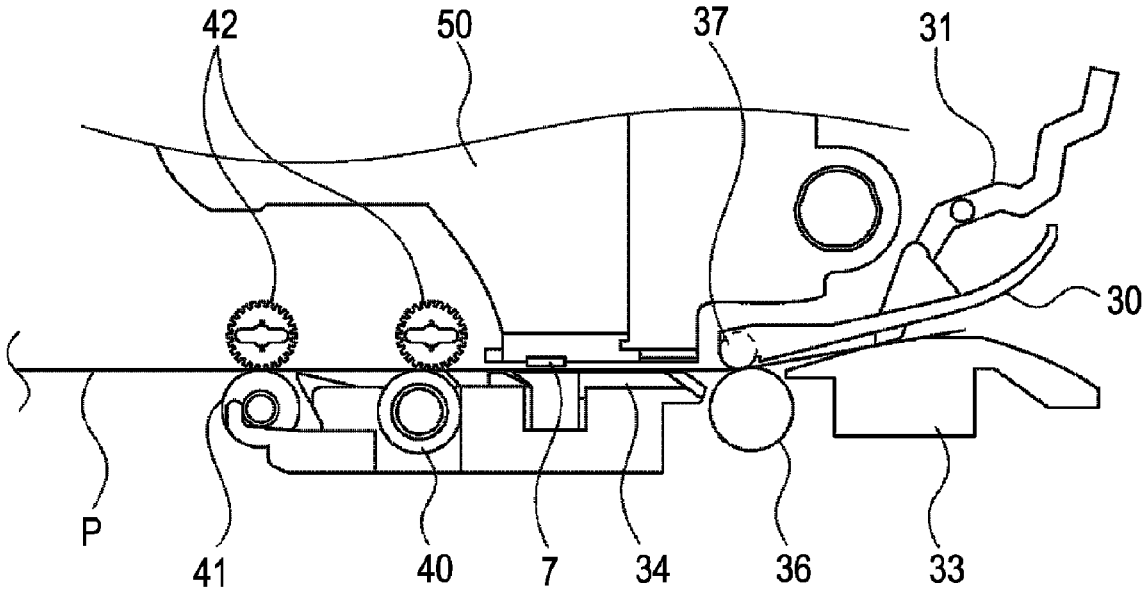
FIGS. 3A and 3B are cross-sectional views illustrating states before and after the trailing end of a recording material passes through a conveying roller, respectively.
Figure 3B:
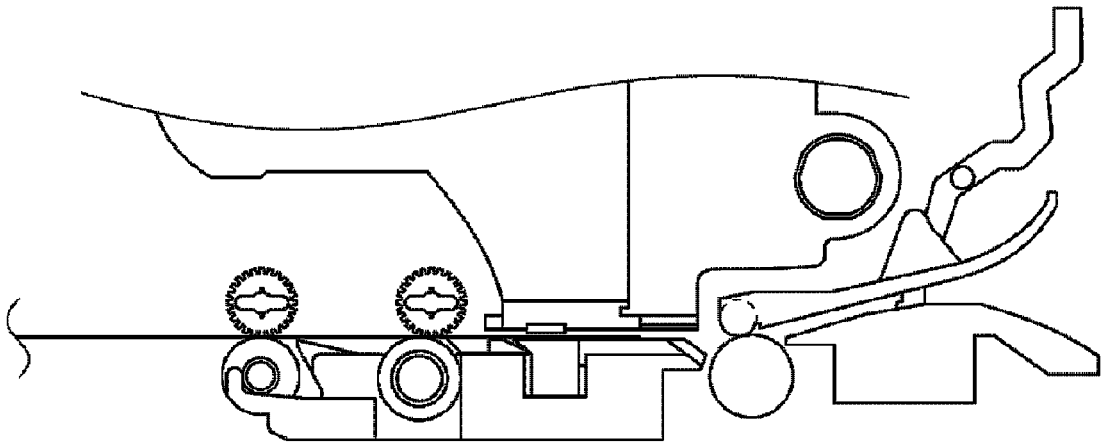
Figure 4:
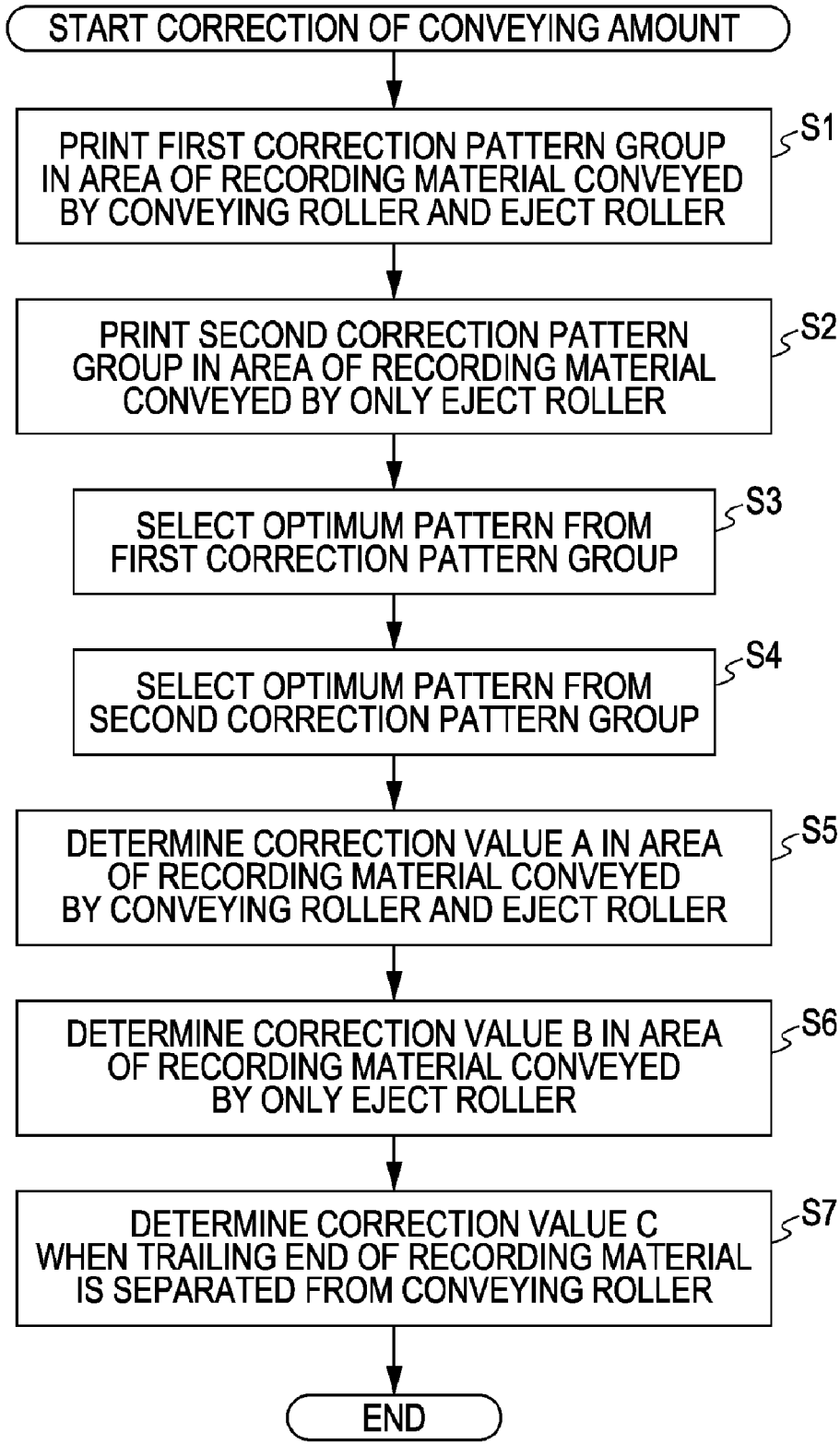
FIG. 4 is a flow chart illustrating operations for correcting the conveying amount of the recording material.
Figure 5:
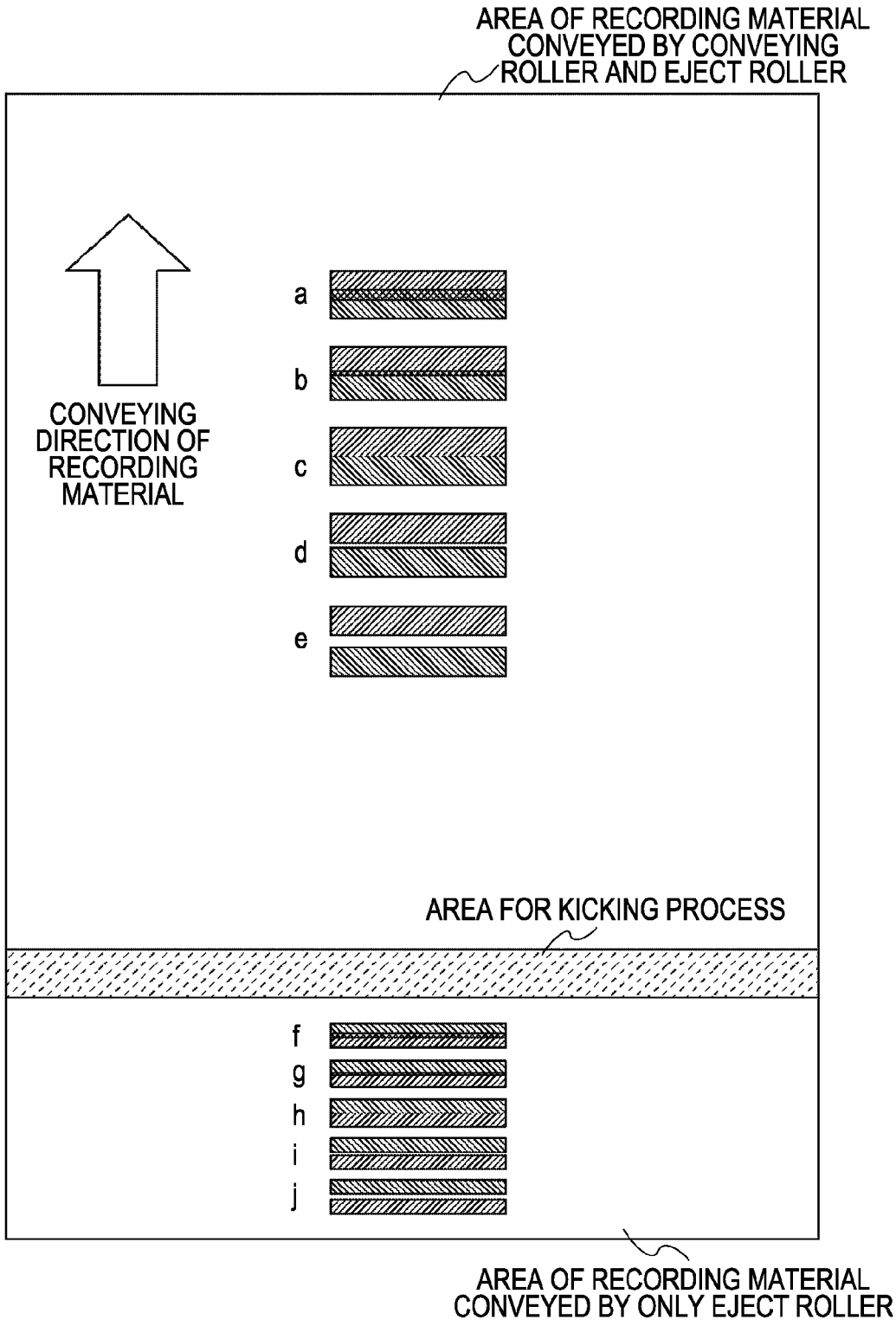
FIG. 5 is a test pattern used for correcting the conveying amount.
Figure 6:
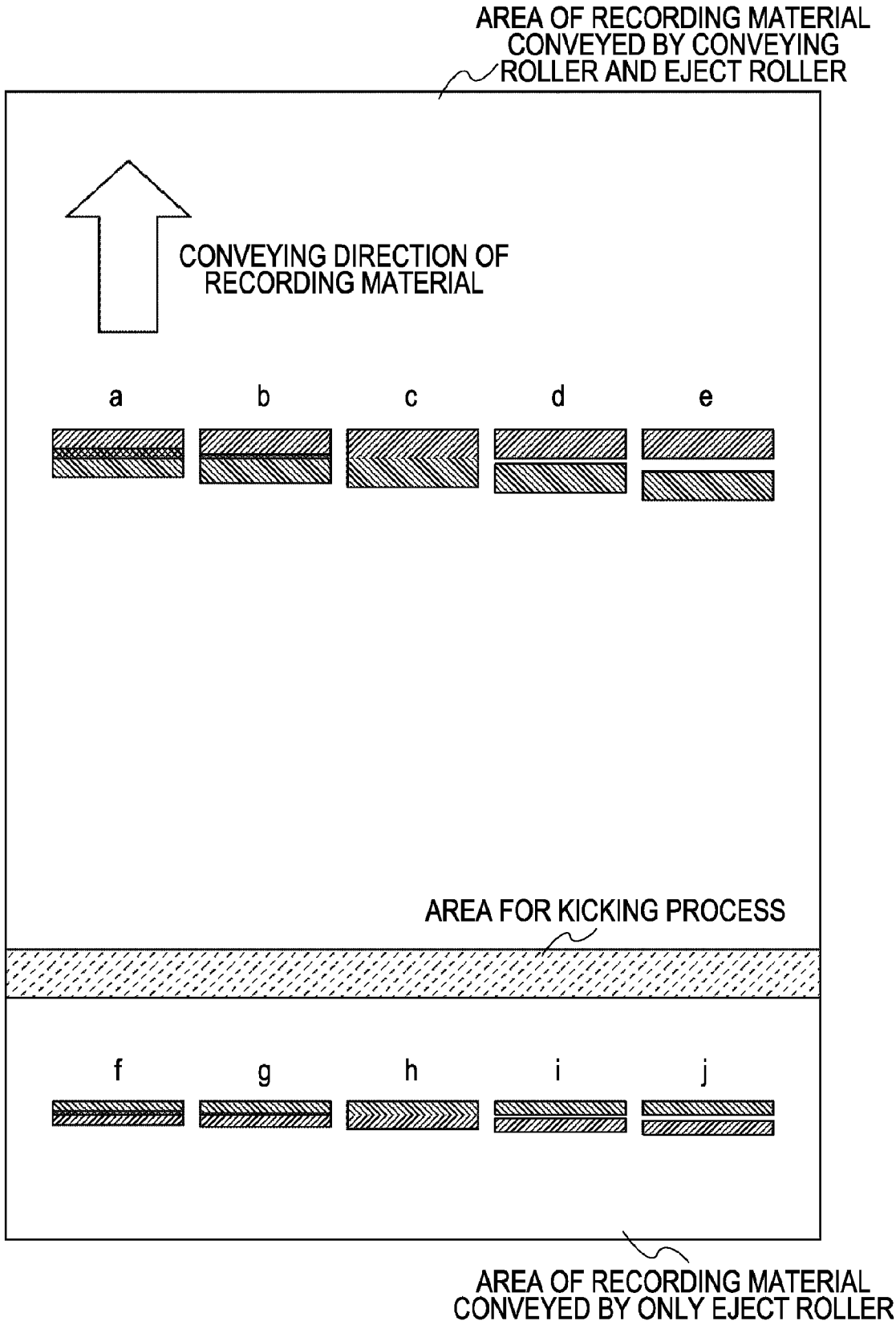
FIG. 6 is a test pattern used for correcting the conveying amount.

FIGS. 3A and 3B are cross-sectional views illustrating states before and after the trailing end of a recording material passes through the conveying roller, respectively. FIG. 4 is a flow chart illustrating operations for correcting the conveying amount of the recording material. FIGS. 5 and 6 are test patterns used for correcting the conveying amount.

Operations for correcting the conveying amount of the recording materials P will now be described with reference to the flow chart shown in FIG. 4. First, a recording material P is set in the feeding section 2. The recording material P fed by the feeding section 2 is sent to the nip formed between the conveying roller 36 and the pinch rollers 37. At this moment, the recording position on the recording material P is determined by detecting the leading end of the recording material using the PE sensor lever 31. The recording material P is conveyed on the platen 34, and the leading end of the recording material P is nipped between the first eject roller 40 and the driven rollers 42. While the recording material P is nipped by the conveying roller unit and an eject roller unit formed of the first eject roller 40 and the driven rollers 42, a first correction pattern group (patterns a to e shown in FIGS. 5 and 6) is printed on the recording material P (Step S1). The pattern group can be printed before the leading end of the recording material P is nipped between the first eject roller 40 and the driven rollers 42. However, the pattern group is printed after the leading end of the recording material P is nipped by the eject roller unit in an exemplary embodiment since the movement of the recording material is stabilized. The correction value for the first correction pattern group is changed by 2/115,200 inches per 32 rasters (in a unit of 1200 dpi), which is a basic feed. That is, when the patterns a to e are printed by 128 rasters (target feed of 2.7093 mm), the correction value is changed by $\alpha=4\times25.4\times2/115{,}200\approx1.8$ μm. The patterns a to e are printed by the following conveying amounts.

Pattern $a$=2.7093−0.0035=2.7058 mm

Pattern $b$=2.7093−0.0018=2.7075 mm

Pattern $c$=2.7093+0=2.7093 mm

Pattern $d$=2.7093+0.0018=2.7111 mm

Pattern $e$=2.7093+0.0035=2.7128 mm

The correction value is not limited to that described above, and can be determined for each apparatus. Since the patterns are aligned in the conveying direction of the recording material in FIG. 5, the eccentricity of the conveying roller 36 can affect the patterns. However, the influence is not large since the tolerance of the eccentricity (deviation) is small with respect to the tolerance of the outer diameter of the conveying roller 36 in the recording apparatus according to an exemplary embodiment. When a higher accuracy in conveyance is required and it is necessary to consider the influence of the eccentricity, the patterns can be aligned in the width direction of the recording material as shown in FIG. 6. In this case, the pattern a is printed first, and the conveying roller 36 is rotated in a reverse direction. Subsequently, the pattern b is printed, and the conveying roller 36 is rotated in the reverse direction again. In the same manner, the patterns c to e are also printed. Since the patterns aligned in the width direction of the recording material can be printed at substantially the same position on the contour of the conveying roller 36, the influence of the eccentricity of the conveying roller 36 can be eliminated.

Next, the recording material P is conveyed until the trailing end of the recording material P is sufficiently separated from the conveying roller unit. Subsequently, a second correction pattern group (patterns f to j shown in FIGS. 5 and 6) is printed while the recording material P is nipped by only the eject roller unit (Step S2). The correction value for the second correction pattern group is changed by 2/115,200 inches per 32 rasters (in the unit of 1200 dpi), which is the basic feed. That is, when the patterns f to j are printed by 128 rasters (target feed of 2.7093 mm), the correction value is changed by $\beta=4\times25.4\times2/115{,}200\approx1.8$ μm. The patterns f to j are printed by the following conveying amounts.

Pattern $f$=2.7093−0.0035=2.7058 mm

Pattern $g$=2.7093−0.0018=2.7075 mm

Pattern $h$=2.7093+0=2.7093 mm

Pattern $i$=2.7093+0.0018=2.7111 mm

Pattern $j$=2.7093+0.0035=2.7128 mm

The correction value is not limited to that described above, and can be determined for each apparatus. The patterns can be aligned in the width direction of the recording material as described above using the first correction pattern group.

After the first and second correction pattern groups are printed, patterns having fewer streaks are selected from the patterns a to e and the patterns f to j printed on the recording material P that has been ejected (Steps S3 and S4). That is, a correction value A in an area of the recording material P conveyed by the conveying roller unit and the eject roller unit and a correction value B in an area of the recording material P conveyed by only the eject roller unit are determined (Steps S5 and S6). In an exemplary embodiment, a user visually selects the optimum patterns from the correction patterns printed on the recording material P. The selection of the patterns is not limited to the above-described method. For example, a reading sensor for optically reading the patterns can be provided for the carriage such that optimum patterns are selected on the basis of changes in density of the patterns.

In this manner, the correction value A in the area of the recording material P conveyed by the conveying roller unit and the eject roller unit and the correction value B in the area of the recording material P conveyed by only the eject roller unit are determined. Next, a method for determining a correction value when the trailing end of the recording material is separated from the conveying roller unit using these two correction values will be described.

In recent ink-jet recording apparatuses, a particular process (hereinafter referred to as "kicking process") is performed in an area of the recording material while the trailing end of the recording material is separated from the conveying roller unit. First, the kicking process will be described. When the trailing end of the recording material is separated from the conveying roller unit during a normal line-feed operation, it cannot be determined where in the line-feed operation the trailing end of the recording material is separated from the conveying roller unit. That is, when the trailing end of the recording material, which is in the vicinity of the conveying roller unit, completely passes through the conveying roller unit by one line-feed operation, no problem occurs since the recording material is not disposed in the conveying roller unit after the line feed. On the other hand, when the trailing end of the recording material, which is in the vicinity of the conveying roller unit, is still located in the vicinity of the nip formed by the conveying roller unit after one line-feed operation, the position of the conveying roller unit cannot be stabilized, and can be rotated by the recording material. Thus, the kicking process is performed so as to stabilize the movement of the recording material P and to improve recording accuracy.

Figure 7:
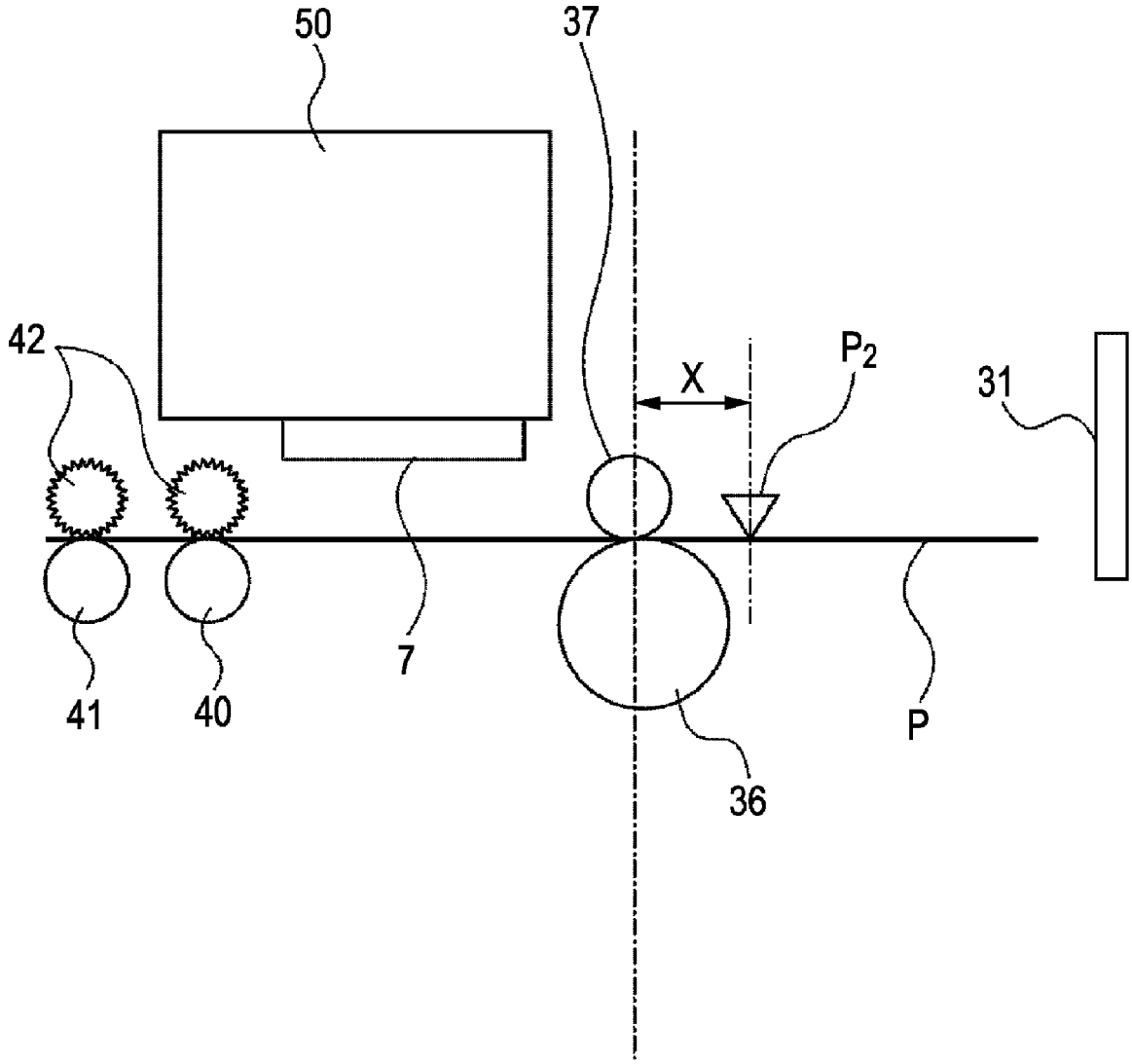
FIG. 7 illustrates a kicking process.

FIG. 7 illustrates the kicking process. In FIG. 7, the recording head 7 makes a recording on a recording material P while the recording material P is being conveyed from right to left. The trailing end of the recording material is separated from the PE sensor lever 31. When the PE sensor lever 31 is rotated, the position of an end of the PE sensor lever 31 is changed, and the PE sensor lever blocks light from entering the PE sensor. With this, the position of the trailing end of the recording material P can be precisely detected. Moreover, the relative positional relationship between the trailing end of the recording material and the nip formed by the conveying roller unit can be determined from the distance between the PE sensor lever 31 and the conveying roller unit, the distance being determined by the mechanical structure. Herein, a point P2 is defined at a position remote from that of the nip formed by the conveying roller unit by a distance X. When it is expected that the trailing end of the recording material P is disposed at a side of the point P2 adjacent to the nip formed by the conveying roller unit (downstream of the point P2 in the conveying direction) after the next line feed, the amount of the next line feed is increased such that the trailing end of the recording material is reliably disposed downstream of the nip formed by the conveying roller unit. With this, the trailing end of the recording material does not stop in the nip formed by the conveying roller unit after the line feed.

In existing products, a predetermined correction value during such a line feed is retained in the main bodies. However, as a higher image quality level is required, white and black streaks caused by variation in the amount of line feed during this kicking process have become a problem. According to an aspect of an embodiment of the present invention, such white and black streaks can be eliminated.

In an embodiment of the present invention, a correction value C during the kicking process is determined for each apparatus from the mean value of the correction value A and the correction value B. In an exemplary embodiment, the amount of line feed during the kicking process is set to 128 rasters (in the unit of 1200 dpi; 2.7093 mm). However, the present invention is not limited to this. Herein, the pattern a is selected from the patterns recorded in the area of the recording material conveyed by the conveying roller unit and the eject roller unit, and the correction value A is determined as $-2\alpha$. On the other hand, the pattern g is selected from the patterns recorded in the area of the recording material conveyed by only the eject roller unit, and the correction value B is determined as $-\beta$. In this case, the correction value C per unit line feed is calculated by determining the mean value of the correction value A and the correction value B, and determined as $(-2\alpha-\beta)/2=(-3.5-1.8)/2=-2.65$ μm (during the kicking process while the recording material is fed by 128 rasters). When the calculation result is indivisible by the resolution of the correction value, the correction value C can be modified in accordance with the resolution. In an exemplary embodiment, the correction value C is simply determined from the mean value of the correction value A and the correction value B. However, relational expressions can be derived from experiments or the like, or can be derived from the nipping pressure applied to the recording material by the conveying roller unit and the eject roller unit.

Moreover, the correction value C can be determined from a ratio of the length of the area of the recording material conveyed by the conveying roller unit and the eject roller unit during a line feed in the kicking process (distance between the nip and the trailing end before the line feed) to the length of the area of the recording material conveyed by only the eject roller during the line feed in the kicking process (distance between the nip and the trailing end after the line feed).

Moreover, the correction value can be changed in accordance with the types, sizes, or recording qualities of recording materials.

In an exemplary embodiment, the correction values A, B, and C are determined using a recording material that is conveyed in practice. However, the correction values can be determined using only a reference recording material that is conveyed in practice, and other correction values for different types, sizes, and recording qualities of recording materials other than the reference recording material can be determined using relational expressions.

According to an exemplary embodiment of the present invention, a recording apparatus having a simple structure capable of calculating the correction value when the trailing end of a recording material is separated from the conveying roller and capable of high-quality recording using the correction value is provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2006-225510 filed Aug. 22, 2006, which is hereby incorporated by reference herein in its entirety.

What is claimed is:

1. A recording apparatus comprising:

a conveying roller configured to convey a recording material disposed upstream of a recording head for making a recording on the recording material in a direction in which the recording material is conveyed;

an eject roller configured to convey the recording material disposed downstream of the recording head in the direction in which the recording material is conveyed, wherein the recording apparatus is capable of recording in an area of the recording material while the recording material is engaged by the eject roller and not engaged by the conveying roller using the recording head; and a control unit configured to calculate a third correction value for a conveying amount of the recording material, when a trailing end of the recording material is separated from the conveying roller, using a first correction value associated with an area of the recording material conveyed by the conveying roller and the eject roller and a second correction value associated with an area of the recording material conveyed by only the eject roller, wherein the third correction value is determined from a ratio of the length of the area of the recording material conveyed by the conveying roller and the eject roller to the length of the area of the recording material conveyed by the eject roller during a line feed when the trailing end of the recording material is separated from the conveying roller.

2. The recording apparatus according to claim 1, wherein the first correction value is used to determine a conveying amount of the recording material to be used while the recording material is engaged by both the conveying roller and the eject roller.

3. The recording apparatus according to claim 1, wherein the second correction value is used to determine a conveying amount of the recording material to be used while the recording material is engaged by the eject roller and not engaged by the conveying roller.

4. The recording apparatus according to claim 1, wherein the first correction value is determined by printing a plurality of patterns on recording material and examining the printed patterns, each of the patterns being associated with a different correction value.

5. The recording apparatus according to claim 4, wherein the plurality of patterns are printed on the recording material while the recording material is engaged by both the conveying roller and the eject roller.

6. The recording apparatus according to claim 1, wherein the second correction value is determined by printing a plurality of patterns on recording material and examining the printed patterns, each of the patterns being associated with a different correction value.

7. The recording apparatus according to claim 6, wherein the plurality of patterns are printed on the recording material while the recording material is engaged by the eject roller and not engaged by the conveying roller.

8. The recording apparatus according to claim 4, wherein the patterns are aligned in the direction in which the recording material is conveyed.

9. The recording apparatus according to claim 6, wherein the patterns are aligned in the direction in which the recording material is conveyed.

10. The recording apparatus according to claim 4, wherein the patterns are aligned in a width direction of the recording material.

11. The recording apparatus according to claim 6, wherein the patterns are aligned in a width direction of the recording material.

12. The recording apparatus according to claim 4, wherein a user visually selects a pattern from the plurality of patterns so as to determine the first correction value.

13. The recording apparatus according to claim 6, wherein a user visually selects a pattern from the plurality of patterns so as to determine the second correction value.

14. The recording apparatus according to claim 4, wherein the first correction value is determined by reading the plurality of patterns and selecting a pattern from the plurality of patterns using a reading sensor.

15. The recording apparatus according to claim 6, wherein the second correction value is determined by reading the plurality of patterns and selecting a pattern from the plurality of patterns using a reading sensor.

16. The recording apparatus according to claim 1, wherein the third correction value is the mean value of the first correction value and the second correction value.

17. A method for correcting a conveying amount of a recording material in a recording apparatus, the recording apparatus including a conveying roller configured to convey a recording material disposed upstream of a recording head for making a recording on the recording material in a direction in which the recording material is conveyed and an eject roller configured to convey the recording material disposed downstream of the recording head in the direction in which the recording material is conveyed, the recording apparatus capable of recording in an area of the recording material while the recording material is engaged by the eject roller and not engaged by the conveying roller using the recording head, the method comprising:

printing a first pattern group in an area of the recording material while the recording material is engaged by both the conveying roller and the eject roller, each pattern having an individual correction value;

printing a second pattern group in an area of the recording material while the recording material is engaged by the eject roller and not engaged by the conveying roller, each pattern having an individual correction value;

determining a first correction value for determining a conveying amount of the recording material to be used while the recording material is engaged by both the conveying roller and the eject roller by selecting a pattern from the first pattern group;

determining a second correction value for determining a conveying amount of the recording material to be used while the recording material is engaged by the eject roller and not engaged by the conveying roller by selecting a pattern from the second pattern group; and determining a third correction value for determining a conveying amount when a trailing end of the recording material is separated from the conveying roller using the first correction value and the second correction value, wherein the third correction value is determined from a ratio of the length of the area of the recording material conveyed by the conveying roller and the eject roller to the length of the area of the recording material conveyed by the eject roller during a line feed when the trailing end of the recording material is separated from the conveying roller.

* * * * *